US008795584B2

(12) United States Patent
Schiess et al.

(10) Patent No.: US 8,795,584 B2
(45) Date of Patent: Aug. 5, 2014

(54) FREE-MACHINING POWDER METALLURGY STEEL ARTICLES AND METHOD OF MAKING SAME

(75) Inventors: Olivier Schiess, Biel (CH); Pierre Marechal, Rheinfelden (CH); Gregory J. Del Corso, Reading, PA (US)

(73) Assignee: CRS Holdings, Inc., Wilmington, DE (US)

( * ) Notice: Subject to any disclaimer, the term of this patent is extended or adjusted under 35 U.S.C. 154(b) by 54 days.

(21) Appl. No.: 13/592,541

(22) Filed: Aug. 23, 2012

(65) Prior Publication Data

US 2012/0321500 A1 Dec. 20, 2012

Related U.S. Application Data

(62) Division of application No. 12/558,066, filed on Sep. 11, 2009, now Pat. No. 8,282,701.

(60) Provisional application No. 61/096,504, filed on Sep. 12, 2008.

(51) Int. Cl.

| | |
|---|---|
| ***B22F 3/12*** | (2006.01) |
| ***B22F 3/15*** | (2006.01) |
| ***B22F 3/18*** | (2006.01) |
| ***B22F 3/24*** | (2006.01) |

(52) U.S. Cl.
USPC ..... 419/27; 419/17; 419/29; 419/49

(58) Field of Classification Search
CPC ..... B22F 5/12
USPC ..... 419/28
See application file for complete search history.

(56) References Cited

U.S. PATENT DOCUMENTS

| | | | | |
|---|---|---|---|---|
| 2,888,740 | A * | 6/1959 | Danis | 428/558 |
| 4,249,945 | A * | 2/1981 | Haswell et al. | 75/241 |
| 5,017,437 | A * | 5/1991 | Martin et al. | 428/558 |
| 5,522,914 | A * | 6/1996 | Stasko et al. | 75/231 |
| 5,989,490 | A * | 11/1999 | Pinnow et al. | 419/11 |
| 6,238,455 | B1 * | 5/2001 | Brown et al. | 75/243 |
| 6,797,031 | B1 * | 9/2004 | Engstrom | 75/246 |

* cited by examiner

*Primary Examiner* — George Wyszomierski
*Assistant Examiner* — Ngoclan T Mai
(74) *Attorney, Agent, or Firm* — Dann, Dorfman, Herrell and Skillman, P.C.

(57) ABSTRACT

A small diameter, elongated steel article, comprising fully consolidated, prealloyed metal powder is disclosed. The consolidated metal powder has a microstructure that has a substantially uniform distribution of fine grains having a grain size of not larger than about 9 when determined in accordance with ASTM Standard Specification E 112. The microstructure of the consolidated metal powder is further characterized by having a plurality of substantially spheroidal carbides uniformly distributed throughout the consolidated metal powder that are not greater than about 6 microns in major dimension and a plurality of sulfides uniformly distributed throughout the consolidated metal powder wherein the sulfides are not greater than about 2 microns in major dimension. A process for making the elongated steel article is also disclosed.

20 Claims, No Drawings

FREE-MACHINING POWDER METALLURGY STEEL ARTICLES AND METHOD OF MAKING SAME

CROSS-REFERENCES TO RELATED APPLICATIONS

This application is a divisional of U.S. application Ser. No. 12/558,066, filed on Sep. 11, 2009, now U.S. Pat. No. 8,282,701, which claims the benefit of U.S. Provisional Application No. 61/096,504, filed Sep. 12, 2008, the entireties of which are incorporated herein by reference.

BACKGROUND OF THE INVENTION

1. Field of the Invention

This invention relates generally to free-machining steel articles and in particular to small diameter wire and bar made from substantially lead-free, free-machining, powder metallurgy steel and to a process for making same.

2. Description of Related Art

Very small, precision parts, such as watch components, are produced by machining small diameter (≤15mm) coils and bars that are made from larger diameter, cold drawn coils and straightened bars. The wire is formed from a cast and wrought steel alloy. To attain good machinability, the coils and barstock are produced from an alloy that contains one or more free-machining additives such as lead (Pb) and/or sulfur (S). The Pb and/or S addition(s) result(s) in the formation of manganese sulfide (MnS) and Pb inclusions, respectively, during the solidification of the cast alloy. The presence of these inclusions decreases the hot and cold workability of the product and also promotes surface defects on the machined part.

Lead is an element that is beneficial to good machinability in the steels used to make precision parts. However, there are disadvantages associated with the production and use of Pb-alloyed steels to make high precision parts. It has proven difficult to control the fineness and even distribution (dispersion) of the Pb in the alloy matrix, the segregation and coalescence of lead inclusions during solidification, and the reproducibility of the process from ingot to ingot and heat to heat. In alloys that contain both Pb and S additions, the Pb and MnS do not interact chemically with each other, although Pb is sometimes becomes physically attached to the MnS inclusions, partially coating them. Because Pb does not dissolve into or bind with iron in steel, it is present only as essentially pure stand-alone inclusions. The use of lead also presents significant health and safety risks that must be addressed during the mill processing operations as well as during the high speed dry machining operations. The high vapor pressure of Pb (i.e. up to about 700 mbar at the temperatures which might be reached during machining) causes Pb to become a major environmental and health problem in dry machining of alloys that contain that element as a free-machining additive.

In steels containing sulfur additions, the sulfur is present substantially in the form of MnS inclusions. Because MnS melts below the solidification temperature range of these steels, it is present as intergranular (interdendritic) inclusions only. Their sizes and distribution depend exclusively on the solidification rate of the ingots. Consequently, it is not possible to avoid the segregation and coalescence of MnS in the as-cast structure and the formation of a wide size spectrum of MnS inclusions, ranging from fine sized inclusions up to very large ones (e.g., ≈125 μm in length) after hot deformation of the alloy. Such a morphology leads to the presence of inclusion-stringers in the free-machining steels. The tolerances (<IT 4-5 Tolerance grade, i.e., <1–2 μm) and surface roughness (Ra of <0.05 μm) required for precision machining of coils and bars made from such steels are very tight. MnS inclusions in resulfurized, lead-bearing 1% C-steels form surface discontinuities at sites of emergence on the surface of such steels, thereby resulting in surface defects that are undesirable in the metal in the machined parts.

The morphologies of the MnS and Pb inclusions of the known steels, also limit the economically achievable precision of the cold drawn wires and straightened bars to a finished tolerance grade ≥IT 6, where IT is the Tolerance grade according to the DIN ISO 286 Standard. Further, the precision, including ovality or out-of-roundness, of the cold drawn wires and cold-drawn and straightened bars, relates directly to the dynamic stability and stiffness or rigidity of the machining process. Therefore, the dynamic stability of the machining process controls the achievable precision and surface quality of the machined parts.

BRIEF SUMMARY OF THE INVENTION

In accordance with one aspect of this invention, there is provided a precision machining coil and bar made from a steel alloy that is substantially free of Pb. The steel alloy is made from prealloyed metal powder that contains S or other non-Pb free-machining additive. The machining coils and straightened bars according to this aspect of the invention are characterized by a microstructure including a substantially uniform, fine grain size, preferably an ASTM E-112 grain size of about 9 or finer, a uniform distribution of MnS's that are not greater than about 2 microns in major dimension, and a uniform dispersion of fine, spheroidal carbides that are not greater than about 6 μm in major dimension. The precision machining coils and bars according to this aspect of the invention are further characterized by having a very high degree of precision, Tolerance grade of <IT 6, preferably IT 4 to IT 6.

In accordance with another aspect of this invention, there is provided annealed drawing wire made from a prealloyed, powder metallurgy steel that is substantially free of Pb. The wire according to this aspect of the invention is characterized by a microstructure including a substantially uniform, fine grain size, preferably an ASTM E-112 grain size of about 9 or finer, a uniform distribution of MnS's that are not greater than about 2 microns in major dimension, and a uniform dispersion of fine, spheroidal carbides that do not exceed about 6 μm in major dimension.

In accordance with a further aspect of this invention, there is provided a process for making a free machining steel article for use in fabricating small, precisely-shaped, high surface quality parts that are machined from small diameter coils and barstock produced from drawn wire. The process according to this invention produces a product that has the machinability of leaded steel, but without the health, safety, and surface quality problems associated with the use of Pb. The process according to the present invention accomplishes these goals by producing a small diameter wire product that has a controlled microstructure. The microstructure provided by the process consists of a fine-grained steel containing a controlled fine carbide morphology and a uniform distribution of very fine MnS particles. This microstructure is obtained by using a steel alloy having a controlled chemistry and processing the alloy by gas atomizing the alloy to powder form. The metal powder is hot consolidated, hot worked to an elongated intermediate form, cold drawn to a finished diameter, and then heat treated with a novel annealing cycle.

DETAILED DESCRIPTION OF THE INVENTION

A preferred embodiment of the process according to the invention includes the step of hot isostatically pressing (HIP) a canister containing gas atomized, prealloyed metal powder. The HIP'd canister is subsequently hot worked and cold finished to produce coiled wire which is cut into small segments of coil and barstock for machining into precision parts and shapes. The composition of the prealloyed powder and the subsequent processing of the powder into the final coil and bar product are designed to produce a fine-grained material containing a fine carbide morphology and a uniform distribution of very fine MnS inclusions. A preferred composition of the product made by the process of the invention is as follows, in weight (mass) percent.

| | |
|---|---|
| C | 0.88-0.98 |
| Mn | 0.40-0.55 |
| Si | 0.12-0.22 |
| P | 0.030 max. |
| S | 0.010-0.075 |
| N | 0.060 max. |
| Cr | 0.25 max. |
| Ni | 0.25 max. |
| Mo | 0.25 max. |

The balance of the alloy is iron and usual impurities.

It is contemplated that the process described herein can be used to produce wire and very small diameter machining bar for precision parts made from other alloys. More specifically, the process can be used with martensitic stainless steels such as Alloys 1 to 4 below, as well as austenitic stainless steel such as Alloy 5 below, each of which consists essentially of, in weight percent, about

| | Alloy 1 | Alloy 2 | Alloy 3 | Alloy 4 | Alloy 5 |
|---|---|---|---|---|---|
| C | 0.43-0.50 | 0.43-0.50 | 0.14-0.23 | 0.12-0.17 | 0.030 max. |
| Mn | 1.50 max. | 1.00 max. | 1.0 max. | 0.3-0.8 | 1.50 max. |
| Si | 0.60 max. | 1.00 max. | 1.0 max. | 0.2-0.6 | 0.80 max. |
| P | 0.030 max. | 0.040 max. | 0.045 max. | 0.04 max. | 0.030 max. |
| S | 0.010-0.090 | 0.010-0.090 | 0.010-0.030 | 0.010-0.030 | 0.010-0.030 |
| Ni | 0.75-1.25 | 0.75-1.25 | 1.5-2.5 | 1.5-2.5 | 11.5-14.0 |
| Cr | 12.50-14.00 | 12.50-14.50 | 15.5-17.5 | 15.5-17.0 | 17.0-20.0 |
| Mo | 1.00-1.20 | 1.20 max. | — | — | 2.0-3.0 |
| Cu | — | — | — | — | 0.50 max. |

The balance of each alloy is iron and usual impurities. The techniques described herein can be used to make precision drawing wire and small diameter precision machining bar from austenitic and martensitic stainless steels.

The prealloyed powder is preferably produced by vacuum induction melting a heat of the steel and then gas atomizing the molten steel. Preferably, the metal powder is produced by atomization with nitrogen gas in an induction melting, gas atomization unit. The atomized powder is preferably screened to about −100 mesh and blended with one or more other heats having essentially the same alloy composition to produce a blended metal powder. The powder blend is vibration filled into a stainless steel or low carbon steel canister. The powder-filled canister is then vacuum hot outgassed and sealed. Hot outgassing is described, for example, in U.S. Pat. No. 4,891,080, the entirety of which is incorporated herein by reference. The sealed canister is hot isostatically pressed (HIP'd) preferably at about 2050° F. and 15 ksi for a time sufficient to fully densify the metal powder. Argon gas is preferred as the pressurizing fluid. After HIP'g the fully dense metal powder is hot rolled from a temperature of about 1149° C. (2100° F.) to form a billet that includes the consolidated metal powder and a cladding consisting of the stainless or low carbon steel alloy of the canister. The hot-rolled billet is process annealed by heating it below the $Ac_1$ temperature. The annealed billet is then cut into pieces and hot rolled again to produce coils of rod having a round cross section. Preferably the rod has a diameter of about 0.25 to 0.30 inches. The rod is then given a full anneal by heating the coils above the $Ac_1$ temperature. The temperature used in the full-annealing cycle has been found to be critical to obtaining the desired microstructure. The full-annealing cycle includes heating the hot rolled coils of rod to a temperature in the range between the $Ac_1$ and $Ac_{cm}$ temperatures for sufficient time at temperature, followed by slow cooling to room temperature to provide the desired microstructure. The preferred annealing temperature is determined as the sum of the $Ac_1$ temperature and 17% to 40% of the total temperature range between the $Ac_1$ and $Ac_{cm}$ temperatures. Annealing time at temperature is about 8 hours, followed by furnace cooling at about 10C°/hr (18F°/hr) to about 538° C. (1000° F.), and then air cooling to room temperature.

The annealed coils of rod are shaved to remove the remnant carbon steel or stainless steel cladding and are then drawn, preferably at room temperature, through one or more drawing dies to reduce the cross-sectional area. The as-drawn wire is then strand annealed at a temperature below than the $Ac_1$ temperature. The preferred strand annealing temperature range is about 450-550° C. (842-1022° F.). The annealing time is short, preferably less than about 5 minutes. The wire may undergo several cycles of cold drawing followed by strand annealing until the desired diameter is obtained. The drawn wire is typically provided with a diameter of about 1.75 mm, 3 mm, 4.5 mm, or 6.5 mm. Larger diameter wire can also be produced to provide small diameter finished bar up to about 15 mm in diameter.

The wire produced by the foregoing steps is cold drawn to even smaller diameter lengths, preferably about 0.1 to about 6.0 mm in diameter. The wire is preferably cold drawn in multiple steps until the desired diameter is obtained. The wire is annealed between passes at a temperature below the $Ac_1$ temperature at about 450-550° C. (842-1022° F.). The wires are either strand-annealed or annealed as coils in a bell or pit-type furnace under a protective atmosphere, preferably dissociated ammonia. The time at the temperature being in both cases long enough to ensure a full softening of the ferrite-matrix and short enough to avoid a growth or morphological modification by diffusion of the spheroidal carbides. The final size wire is supplied as coils or straightened and cut to form small diameter bar stock that can be machined to produce small, high precision parts such as pivots, axles, gears, pins, and screws for watches and other precision instruments.

The alloy exhibits in the cold drawn condition, a much better cold formability than the known Pb-alloyed carbon steels. That property makes the alloy highly amenable for cold rolling of threads, cold stamping, e.g. of sockets, cold heading, forging in closed dies, bending, and further cold shaping techniques.

WORKING EXAMPLES

The process according to the present invention is designed to provide a microstructure in the alloy that includes the following features: a distribution of small spheroidal carbides, substantially all of which are not more than about 6 microns in major dimension; a uniform distribution of fine sulfides, preferably Mn-rich sulfides, substantially all of which are not more than about 2 microns in major dimension, and a fine grain size, typically an ASTM E 112 grain size of 9 or finer, preferably, ASTM 10 or finer. Processing trials were performed to determine an annealing cycle that produces the desired microstructure. When redrawn wire of the preferred alloy was first processed, it was found to be non-uniform in its microstructure, drawability, and machinability. The condition was determined to be caused by the 760° C. annealing cycle temperature that was used during the processing of the coils. The 760° C. annealing temperature was selected because it had been used for a similar grade of steel. The 760° C. annealing temperature was found to produce an undesirable microstructure consisting of a mixture of coarse and fine carbides as well as a dispersion of fine MnS particles. The microstructure also included a mixture of spherical and pearlitic carbide areas. The formation of the coarse carbides and pearlitic (lamellar) areas was unexpected because the known steel had been made for many years and its annealing temperature and processing is well known. It was determined that the presence of coarse carbides and the pearlitic areas resulted in inconsistent drawability and machinability of the experimental material.

The testing of the first batch of material did show, however, that there was a potential to produce a product with the desired microstructure and a second batch of material was produced for additional testing. The chemistry of the second batch of product was modified from the first batch. Specifically, the second test heat contained lower carbon to reduce the amount of cementite (carbide phase) that forms in the alloy matrix. Additionally, for the second batch of material an initial process annealing cycle with a maximum temperature of 675° C. was used to avoid growing the carbides and to inhibit the formation of the pearlitic areas that were found in the first test batch. Use of only process annealing cycles was selected because the carbides in this hypereutectoid alloy historically can be spheroidized with this type of anneal.

When the second batch of material was produced, it was determined that the coils could not be cold drawn. It was discovered that the reason for the poor drawability was the presence of a pearlitic microstructure. It was subsequently determined with additional annealing trials, that it was surprisingly difficult to obtain the desired fine spherical carbide microstructure without using an initial annealing temperature that exceeded 712° C., the $A_{c1}$ temperature of this particular alloy composition. The amount of heating above the $A_{c1}$ temperature was found to affect the microstructure. If the temperature is too high, the carbides become too coarse. If the temperature is too low, an undesirable amount of pearlite is retained in the microstructure. After further testing, it was found that annealing at about 738° C. (1360° F.) for about 8 hours, followed by furnace cooling at about 10° C./hr to about 538° C. (1000° F.) and then cooling in air to room temperature provided acceptable results for the hot rolled rod coils. Subsequent process annealing cycles at a temperature below the $Ac_1$ temperature were used between cold drawing passes of the rod coils.

As noted previously, the fact that the initial 675° C. long-time process annealing of the alloy failed to produce the desired fine spheroidized carbide microstructure was surprising and was contrary to the teachings of the state of the art. It appears that the powder metallurgy product behaves differently than the known cast-and-wrought steel product. This difference is believed to be caused by the initial rapidly solidified microstructure of the alloy powder in combination with the fine dispersion of MnS's, carbides, oxides, and nitrides related to the powder particles in the material. The fact that the very fine sulfides in the microstructure in combination with the fine spheroidized carbides show the potential to obtain the desired machinability is also surprising. Traditionally, in both powder metallurgy and cast-and-wrought materials, fine sulfide particles are not expected to provide better free-machinability than coarser sulfide particles. We believe that the fine sulfide particles promote better machinability in the product of this invention because when small diameter bars of the preferred steel alloy are machined at high RPM's, such as when producing small diameter machined parts, the fine sulfides are thermally activated or softened during chip formation more easily than the coarser sulfides present in the cast-and-wrought materials.

It is believed that the processing according to the present invention can be applied to small diameter, machinable wire and barstock used to produce precision-machined components made from other alloys including other carbon and alloyed steels as well as martensitic and austenitic stainless steels. Among possible candidate alloys are martensitic stainless steels such as AISI Type 420, AISI Type 431, AISI Type 440A, and AISI Type 440B stainless steels. Similarly machinable austenitic stainless steels, such as AISI Type 316L alloy, and other austenitic alloys of the AISI 300 series, could also benefit from the method of this invention.

The process according to the present invention provides small diameter machining coils and bars that advantageously permits the use of Swiss-type automatic lathes equipped with plain guide bushings (cemented carbides or ceramics) of very close tolerances, typically ±1 μm (±40 μin), than with the classic slotted guides. Such slotted guide bushings are advantageous for allowing the guides to adapt elastically to the effective bar diameter. The cold drawn and straightened bars of the cast and wrought free-machining steels exhibit a significantly larger diameter scatter compared to the machining bars produced by the process of this invention. Diameter deviations of up to 3-5 μm ($2\times10^{-4}$ in)within one bar are not uncommon in the machining bar made from the cast and wrought alloys. In contrast, the fine microstructure of the machining bar provided by the process of this invention eliminates this problem to a large degree. The deviation in the diameter within several batches of up to 150 kg (330 lbs) each did not exceed 1 μm (40 μin). The high reproducibility of the dimensional precision of the cold drawn straightened stocks permits significantly higher productivity during the machining operations. The idle time for set up and adjustment is reduced. The machining tool does not have to be reset in process or from batch to batch of bar material. The plain guide bushings do not have to be run-up to adapt them to a different mean diameter from run to run. The very close fit between the guide bushing and the gliding bar, greatly reduces and may even eliminate altogether, the dynamic micro-chatter of the couple guide bushing-bar which results in a better surface finish in the machined part. Further, the very close fit also effectively eliminates the risk that the guide will scratch the bar during the machining operation. Further still, the much higher dynamic stability of the bar material made by the process of the invention permits machining at significantly higher speeds and feed rates, regardless of whether the operation is turning, drilling, or milling.

The invention claimed is:

1. A method of making a small diameter elongated steel article having good machinability and dimensional stability comprising the steps of melting a steel alloy in a melting furnace;

atomizing the steel alloy with an inert gas to form a prealloyed steel powder having the following weight percent composition, about

| | |
|---|---|
| C | 0.88-0.98 |
| Mn | 0.40-0.55 |
| Si | 0.12-0.22 |
| P | 0.030 max. |
| S | 0.010-0.075 |
| N | 0.060 max. |
| Cr | 0.25 max. |
| Ni | 0.25 max. |
| Mo | 0.25 max. |

and the balance of the alloy is iron and usual impurities:

consolidating the steel powder to substantially full density to form a powder compact;

hot working the powder compact to form an elongated intermediate article;

heating the intermediate article under time and temperature conditions that provide a microstructure characterized by a substantially uniform dispersion of fine carbides and fine sulfides;

cold drawing the elongated intermediate article after said heating step to reduce the cross-sectional area of said elongated intermediate article; and then straightening the reduced cross-sectional area article to provide an elongated article having a small cross section for precision machining of parts.

2. The method according to claim 1 wherein the step of consolidating the steel powder comprises the steps of:

filling the steel powder into a metal container;

hot isostatically compacting the steel powder in the metal container to substantially full density;

mechanically working the compacted steel powder at an elevated temperature to form a billet;

rolling the billet at a second elevated temperature to form an elongated rod; and removing a cladding formed on the surface of the compacted steel powder by the metal container.

3. The method according to claim 2 wherein the removing step comprises shaving the elongated rod to remove the cladding.

4. The method according to claim 2 wherein the removing step is performed after the rolling step.

5. The method according to claim 1 wherein the melting step comprises vacuum induction melting.

6. The method according to claim 1 wherein the atomizing step comprises atomizing the steel alloy with nitrogen gas as the inert gas.

7. The method according to claim 1 wherein the heating step comprises heating the intermediate article at a temperature between the $A_{c1}$ temperature and the $A_{cm}$ temperature of the steel alloy.

8. The method according to claim 1 which further comprises heating the reduced cross-sectional area article at a temperature below the $A_{c1}$ temperature and then cold drawing the reduced cross-sectional area article again to further reduce the cross-sectional area before said straightening step.

9. A method of making a small diameter elogated steel article having good machinability and dimensional stability comprising the steps of melting a steel alloy in a melting furnace;

atomizing the steel alloy with an inert gas to form a prealloyed steel power having the following weight percent composition, about

| | |
|---|---|
| C | 0.43-0.50 |
| Mn | 1.50 max. |
| Si | 0.60 max. |
| P | 0.030 max. |
| S | 0.010-0.090 |
| Cr | 12.50-14.00 |
| Ni | 0.75-1.25 |
| Mo | 1.00-1.20 |

and the balance of the alloy is iron and usual impurities;

consolidating the steel powder to substantially full density to form a powder compact;

hot working the powder compact to form an elongated intermediate article;

heating the intermediate article under time and temperature conditions that provide a microstructure characterized by a substantially uniform dispersion of fine carbides and fine sulfides;

cold drawing the elongated intermediate article after said heating step to reduce the cross-sectional area of said elongated intermediate article; and then straightening the reduced cross-sectional are article to provide an elongated article having a small cross section for precision machining of parts.

10. A method of making a small diameter elongated steel article having good machinability and dimensional stability comprising the steps of melting a steel alloy in a melting furnace;

atomizing the steel alloy with an inert gas to form a prealloyed steel powder having the following weight percent composition, about

| | |
|---|---|
| C | 0.43-0.50 |
| Mn | 1.00 max. |
| Si | 1.00 max. |
| P | 0.040 max. |
| S | 0.010-0.090 |
| Cr | 12.50-14.50 |
| Ni | 0.75-1.25 |
| Mo | 1.20 max. |

and the balance of the alloy is iron and usual impurities;

consolidating the steel powder to substantially full density to form a powder compact;

hot working the powder compact to form an elongated intermediate article;

heating the intermediate article under time and temperature conditions that provide a microstructure characterized by a substantially uniform dispersion of fine carbides and fine sulfides;

cold drawing the elongated intermediate article after said heating step to reduce the cross-sectional area of said elongated intermediate article; and then straightening the reduced cross-sectional area article to provide an elongated article having a small cross section for precision machining of parts.

11. A method of making a small diameter elongated steel article having good machinability and dimensional stability comprising the steps of melting a steel alloy in a melting furnace;

atomizing the steel alloy with an inert gas to form a prealloyed steel powder having the following weight percent composition, about

| | |
|---|---|
| C | 0.14-0.23 |
| Mn | 1.00 max. |
| Si | 1.00 max. |
| P | 0.045 max. |
| S | 0.010-0.030 |
| Cr | 15.5-17.5 |
| Ni | 1.5-2.5 |

and the balance of the alloy is iron and usual impurities;

consolidating the steel powder to substantially full density to form a powder compact;

hot working the powder compact to form an elongated intermediate article;

heating the intermediate article under time and temperature conditions that provide a microstructure characterized by a substantially uniform dispersion of fine carbides and fine sulfides;

cold drawing the elongated intermediate article after said heating step to reduce the cross-sectional area of said elongated intermediate article; and then straightening the reduced cross-sectional area article to provide an elongated article having a small cross section for precision machining of parts.

12. A method of making a small diameter elongated steel article having good machinability and dimensional stability comprising the steps of melting a steel alloy in a melting furnace;

atomizing the steel alloy with an inert gas to form a prealloyed steel powder having the following weight percent composition, about

| | |
|---|---|
| C | 0.12-0.17 |
| Mn | 0.3-0.8 |
| Si | 0.2-0.6 |
| P | 0.04 max. |
| S | 0.010-0.030 |
| Cr | 15.5-17.0 |
| Ni | 1.5-2.5 |

and the balance of the alloy is iron and usual impurities;

consolidating the steel powder to substantially full density to form a powder compact;

hot working the powder compact to form an elongated intermediate article;

heating the intermediate article under time and temperature conditions that provide a microstructure characterized by a substantially uniform dispersion of fine carbides and fine sulfides;

cold drawing the elongated intermediate article after said heating step to reduce the cross-sectional area of said elongated intermediate article; and then straightening the reduced cross-sectional area article to provide an elongated article having a small cross section for precision machining of parts.

13. A method of making a small diameter elongated steel article having good machinability and dimensional stability comprising the steps of melting a steel alloy in a melting furnace;

atomizing the steel alloy with an inert gas to form a prealloyed steel powder having the following weight percent composition, about

| | |
|---|---|
| C | 0.030 max. |
| Mn | 1.50 max. |
| Si | 0.80 max. |
| P | 0.030 max. |
| S | 0.010-0.030 |
| Cr | 17.0-20.0 |
| Ni | 11.5-14.0 |
| Mo | 2.0-3.0 |
| Cu | 0.50 max. |

and the balance of the alloy is iron and usual impurities;

consolidating the steel powder to substantially full density to form a powder compact;

hot working the powder compact to form an elongated intermediate article;

heating the intermediate article under time and temperature conditions that provide a microstructure characterized by a substantially uniform dispersion of fine carbides and fine sulfides;

cold drawing the elongated intermediate article after said heating step to reduce the cross-sectional area of said elongated intermediate article; and then straightening the reduced cross-sectional area article to provide an elongated article having a small cross section for precision machining of parts.

14. The method according to any one of claims 9 to 13 wherein the step of consolidating the steel powder comprises the steps of:

filling the steel powder into a metal container;

hot isostatically compacting the steel powder in the metal container to substantially full density;

mechanically working the compacted steel powder at an elevated temperature to form a billet;

rolling the billet at a second elevated temperature to form an elongated rod; and removing a cladding formed on the surface of the compacted steel powder by the metal container.

15. The method according to claim 14 wherein the removing step comprises shaving the elongated rod to remove the cladding.

16. The method according to claim 14 wherein the removing step is performed after the rolling step.

17. The method according to any one of claims 9 to 13 wherein the melting step comprises vacuum induction melting.

18. The method according to any one of claims 9 to 13 wherein the atomizing step comprises atomizing the steel alloy with nitrogen gas as the inert gas.

19. The method according to any one of claims 9 to 13 wherein the heating step comprises heating the intermediate article at a temperature between the $A_{c1}$ temperature and the $A_{cm}$ temperature of the steel alloy.

20. The method according to any one of claims 9 to 13 which further comprises heating the reduced cross-sectional area article at a temperature below the $A_{c1}$ temperature and then cold drawing the reduced cross sectional area again to further reduce the cross-sectional area before said straightening step.

* * * * *

UNITED STATES PATENT AND TRADEMARK OFFICE

CERTIFICATE OF CORRECTION

PATENT NO. : 8,795,584 B2
APPLICATION NO. : 13/592541
DATED : August 5, 2014
INVENTOR(S) : Olivier Schiess, Pierre Marechal and Gregory J. Del Corso It is certified that error appears in the above-identified patent and that said Letters Patent is hereby corrected as shown below:

In the Claims:

Col. 8, Claim 9,
Line 1, “elogated” should read -- elongated --
Line 6, “power” should read -- powder --
Line 28, “are” should read -- area --

Col. 10, Claim 20,
Line 4, after “area” insert -- article --

Signed and Sealed this
Twenty-first Day of October, 2014

Michelle K. Lee

Michelle K. Lee
*Deputy Director of the United States Patent and Trademark Office*